US011078060B2

(12) United States Patent
Young

(10) Patent No.: US 11,078,060 B2
(45) Date of Patent: Aug. 3, 2021

(54) MULTI-LIFT POINT ELEVATOR AND METHODS OF USING SAME

(71) Applicant: William Oliver Young, Spartanburg, SC (US)

(72) Inventor: William Oliver Young, Spartanburg, SC (US)

( * ) Notice: Subject to any disclaimer, the term of this patent is extended or adjusted under 35 U.S.C. 154(b) by 318 days.

(21) Appl. No.: 16/263,049

(22) Filed: Jan. 31, 2019

(65) Prior Publication Data

US 2019/0233267 A1 Aug. 1, 2019

Related U.S. Application Data

(60) Provisional application No. 62/709,772, filed on Jan. 31, 2018.

(51) Int. Cl.

| | |
|---|---|
| ***B66F 7/22*** | (2006.01) |
| ***B66F 1/02*** | (2006.01) |
| ***B66F 17/00*** | (2006.01) |
| ***B66F 7/28*** | (2006.01) |

(52) U.S. Cl.

CPC ..... *B66F 7/22* (2013.01); *B66F 1/02* (2013.01); *B66F 7/28* (2013.01); *B66F 17/006* (2013.01); *B66F 2700/09* (2013.01)

(58) Field of Classification Search

CPC ..... A47B 2200/0051; A47C 3/40; B66F 7/22; B66F 7/26; B66F 7/28; B66F 1/02; B66F 17/006; B66F 2700/09; B66F 2700/057

USPC ... 254/3 C, 5 C, 7 C, 8 C, 10 B, 10 R, 10 C, 254/45, 93 L; 269/55; 248/188.1, 188.2, 248/188.5, 676, 677

See application file for complete search history.

(56) References Cited

U.S. PATENT DOCUMENTS

| | | | | |
|---|---|---|---|---|
| 3,915,102 A * | 10/1975 | Barron | A47B 9/14 108/146 |
| 5,435,254 A * | 7/1995 | Arney | A47B 21/06 108/64 |
| 6,158,552 A * | 12/2000 | Gould | A47C 12/02 182/200 |
| 6,464,192 B1 * | 10/2002 | Gibbs, Jr. | B66F 1/025 248/352 |

* cited by examiner

*Primary Examiner* — Lee D Wilson
*Assistant Examiner* — Alberto Saenz
(74) *Attorney, Agent, or Firm* — Thrive IP; Bernard S. Klosowski

(57) ABSTRACT

A multi-lift point elevator includes a lifting frame for elevating a plane. The lifting frame includes lift stanchions with telescoping tubes controlled by bias connectors extending into the telescoping tubes from leaf springs connected to the lifting frame. The leaf springs are activated by a connector extension, which urges the leaf springs away from the lift stanchions to release the bias connectors from the telescoping tubes to cause the telescoping tubes to extend or retract as a jack elevates or lowers the plane.

2 Claims, 8 Drawing Sheets

MULTI-LIFT POINT ELEVATOR AND METHODS OF USING SAME

BACKGROUND OF THE INVENTION

1) Field of the Invention

The present invention relates to a multi-lift point elevator, which may be employed to lift a large, cumbersome object via independent lift points in order to elevate an object either levelly or at an angle and methods of use of same.

2) Description of Related Art

When inspecting the bottom or lower portion of a large or heavy object, the object must be raised in order to allow access. To accomplish this, users typically resort to myriad, and sometimes unsafe, methods of lifting the object. This includes lifting the object and propping other objects underneath, to keep the item raised or tilted while the user crawls or moves underneath to inspect the object. Invariably, this results in limited access to the portion being examined and may even result in injuries to the person inspecting the object.

What is needed is a safe and secure device, and methods of using same, to raise a large and cumbersome object to a desired height or incline in a secure and safe manner. Accordingly, it is an object of the present invention to provide a multi-lift point elevator and methods of using same to accomplish this task.

SUMMARY OF THE INVENTION

The above objectives are accomplished according to the present invention by providing in a first embodiment, a multi-lift point elevator. The elevator includes a lifting frame, wherein the lifting frame has an upper lifting surface, a lower raising surface, and the upper lifting surface and the lower raising surface are conjoined to one another. The elevator also includes a first lifting side, a second lifting side, at least one independent lift stanchion affixed to either the first lifting side or the second lifting side and the independent stanchion comprises at least one telescoping member with at least an outer telescoping sleeve and at least one inner telescoping tube.

Further, the elevator includes at least one contact feature for engaging an item being lifted. Still further, the at least one contact feature comprises a polyurethane pad. Further yet, the elevator includes a latching mechanism for variably engaging the at least one inner telescoping tube with the at least one outer telescoping sleeve. Yet again, an outer surface of the inner telescoping tube comprises at least two orifices. Still again, an outer surface of the at least one outer telescoping sleeve comprises at least one engaging orifice. Yet further, the outer telescoping sleeve and inner telescoping tube are positioned relative to one another by inserting a locking mechanism through the orifice of outer telescoping sleeve and one of the orifices of the inner telescoping tube. Still yet further, the elevator includes at least two independent lift stanchions. Still again, the independent lift stanchions raise or lower independently of one another. Further again, the elevator includes release mechanism for unlocking at least one independent lift stanchion. Still yet, the elevator includes at least two independent lift stanchions wherein the locking mechanism unlocks the at least two independent lift stanchions simultaneously. Again yet, the first lifting side and the second lifting side raise and lower independently of one another. Still yet, a first end of the first or second lifting side and a second end of the first or second lifting side are raised independent of one another.

In another embodiment, a method is provided for lifting an object via a multi-lift point elevator. The method includes placing a lifting frame underneath an object, raising a first lifting side of the lifting frame, raising the first lifting side allows at least one inner telescoping tube of at least one first side independent lift stanchion affixed to the first lifting side to slidably move within a first outer telescoping sleeve and lock into place with respect to the first outer telescoping sleeve, raising a second lifting side of the lifting frame, wherein raising the second lifting side allows at least one inner telescoping tube of at least one second side independent lift stanchion affixed to the second lifting side to slidably move within a second outer telescoping sleeve and lock into place with respect to the second outer telescoping sleeve, disengaging a first lifting side locking mechanism securing the at least one inner telescoping tube to the at least one outer telescoping sleeve of the first side lifting stanchion and again raising the first lifting side to allow the at least one inner telescoping tube to slidably move within the outer telescoping sleeve and lock into place with respect to the outer telescoping sleeve, disengaging a second lifting side locking mechanism securing the at least one inner telescoping tube to the outer telescoping sleeve of the second side lifting stanchion then again raising the second lifting side to allow the at least one inner telescoping tube to slidably move within the outer telescoping sleeve and lock into place with respect to the outer telescoping sleeve; and the above continues until the object is raised to a selected height or elevated at a selected incline.

Further, the outer telescoping sleeves and inner telescoping tubes are positioned relative to one another by inserting a locking mechanism through an orifice defined in the outer telescoping sleeves and into an orifice defined into the inner telescoping sleeves. Still yet, gravity controls lowering the inner telescoping tubes. Again, the first lifting side has at least two first side independent lift stanchions wherein these stanchions raise and lower independently of one another. Still again, the second lifting side has at least two second side independent lift stanchions wherein these stanchions raise and lower independently of one another. Yet still, the second lifting side is raised to be at an equal height with the first lifting side.

In a still further embodiment, a multi-lift point elevator is provided. The elevator includes a lifting frame. The lifting frame has an upper lifting surface, a lower raising surface. The upper lifting surface and the lower raising surface are conjoined to one another. The elevator also includes a first lifting side, a second lifting side, and the first lifting side and second lifting side are conjoined to one another. Further, the elevator includes at least two independent lift stanchions affixed to the first lifting side and the second lifting side. The independent lift stanchions comprise at least one telescoping member comprising at least an outer telescoping sleeve and at least one inner telescoping tube; and the independent lift stanchions raise and lower independent of one another.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

Figure 1:
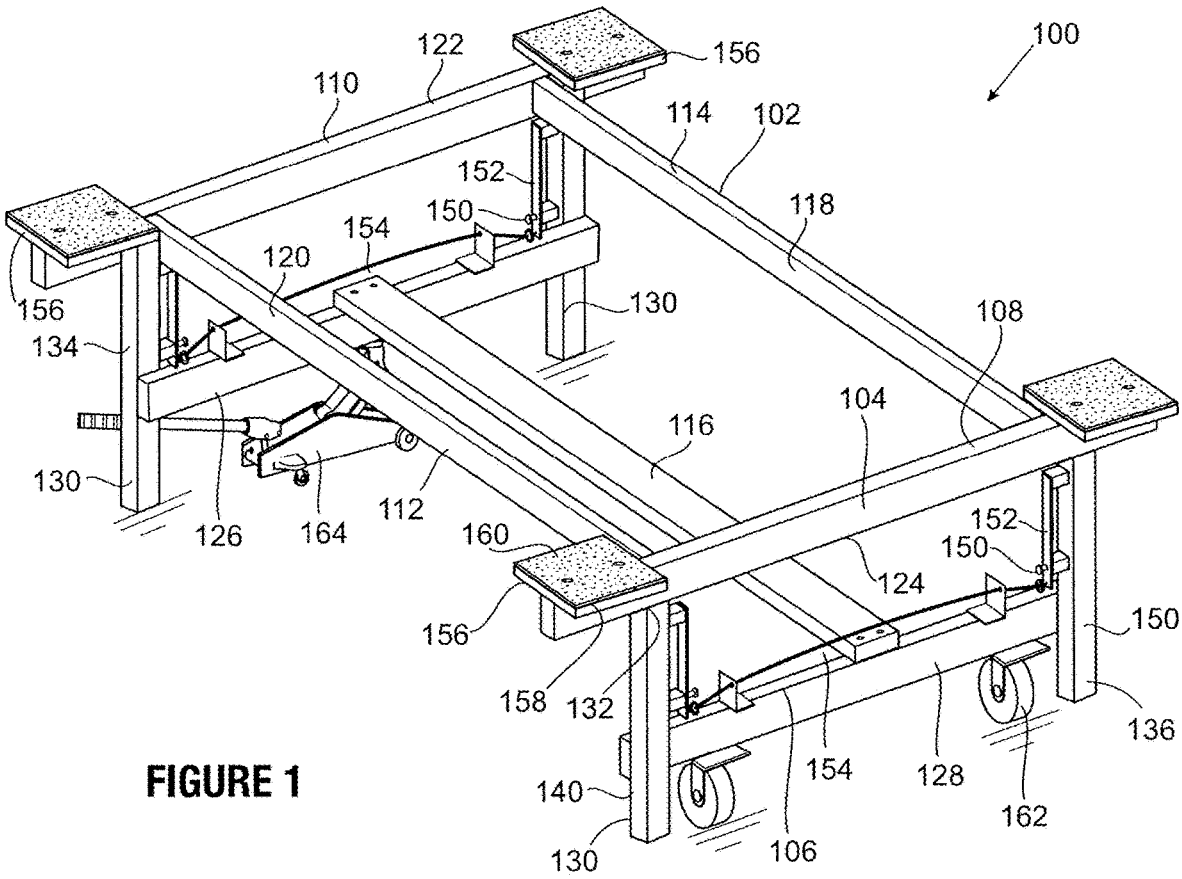
FIG. 1 shows a multi-lift point elevator of the current disclosure.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

The present disclosure provides a multi-lift point elevator 100, see FIG. 1. Multi-lift point elevator 100 includes a lifting frame 102. Lifting frame 102 includes an upper lifting surface 104 and a lower raising surface 106. Lifting frame 102 may be formed from steel bars, rolled aluminum, tubing, or even comprise a solid platform for upper lifting surface 104 and lower raising surface 106. In a preferred embodiment, lifting frame 102 comprises hollow steel tubing. Lifting frame 102 further includes first side 108, second side 110, which is positioned opposite first side 108, third side 112, and fourth side 114, which is positioned opposite third side 112. The sides may be joined or conjoined to one another via cross beams, such first cross beam 116, second cross beam 118, and third cross beam 120 as well as first upper transverse beam 122, second upper transverse beam 124, first lower transverse beam 126 and second lower transverse beam 128. While three cross beams and four transverse beams are shown in FIG. 1, the current disclosure should not be considered so limited as more or less cross beams and transverse beams are considered within the scoped of the disclosure such as 2, 4, 5, 6, 7 or more cross beams and 2, 3, 5, 6, 7, 8, 9, or more transverse beams.

Figure 2:
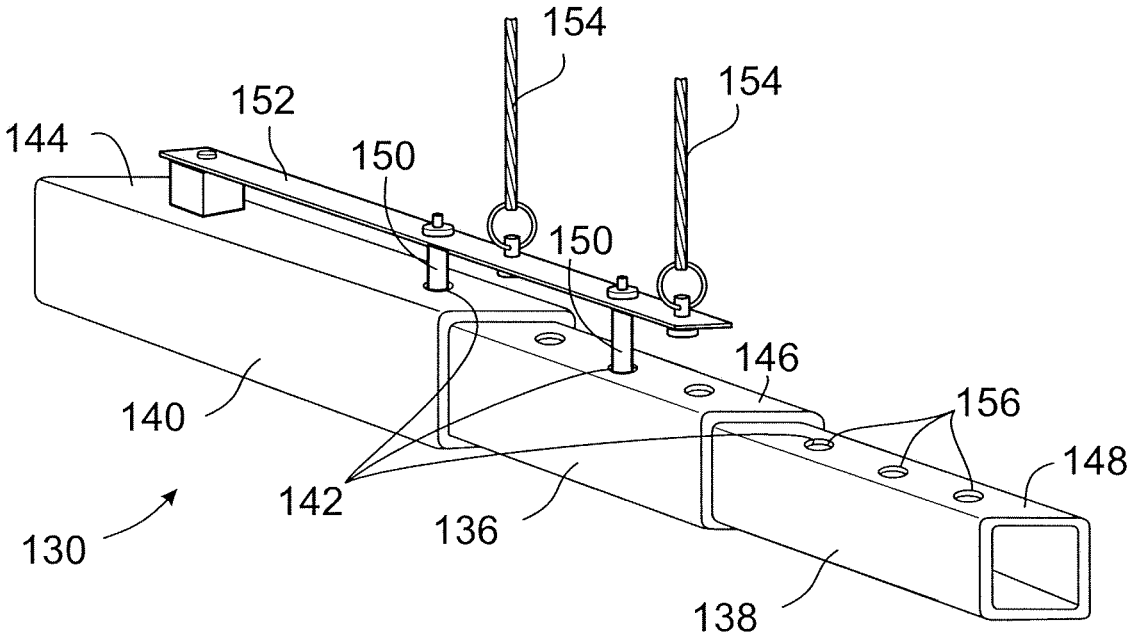
FIG. 2 illustrates an independent lift stanchion of the current disclosure.

Lifting frame 102 also includes at least one independent lift stanchion 130. While four independent lift stanchions 130 are shown in FIG. 1, more or less lift stanchions, such as 1, 2, 3, 5, 6, 7, or more are considered within the scope of this disclosure. Moreover, although lift stanchions 130 are shown at corners 132, lift stanchions 130 may be positioned variably along sides 108, 110, 112, and 114, while a stationary post 134 is used to provide support for lifting frame 102 at corners 132. Indeed, in a further embodiment, lift stanchions 130 may be removably affixed to lifting frame 102 via clamps, cinches, male/female engagement, or other means as known to those of skill in the art, and positioned along the lengths of sides 108, 110, 112, and 114. Further, lift stanchions 130 may be positioned opposite or diagonal to one another, as shown in FIG. 1, but may also be in a staggered formation along sides 108, 110, 112, and 114 as the user prefers. Independent lift stanchions 130 may be hollow and contain at least one telescoping tube 136 or possibly more tubes such as second telescoping tube 138, see FIG. 2. Also, while the word "tube" is used to describe the inner members, these members are not so limited in shape or profile and may comprise a semi-circular leg, a rod, a solid member sliding within a hollow member, a hollow sheath, etc., and the current disclosure should not be considered as limited to a "tube" configuration alone nor should "tube" be confined to a rectangular shape as circles, columns, ellipsoids, etc., are considered within the scope of the invention. In one embodiment, a single telescoping tube 136 is "nested" within outer telescoping sleeve 140. FIG. 2 illustrates independent lift stanchion 130 in a partially extended configuration wherein telescoping tube 136 is extending from outer telescoping sleeve 140 and inner telescoping tube 138 extends from telescoping tube 136. Orifices 142 may be defined within exterior wall 144 of telescoping tube 140, outer wall 146 of telescoping tube 136, and surface wall 148 of inner telescoping tube 138. Orifices 142 preferable define openings extending completely through the wall on upon which they are located. Telescoping sleeve 140, telescoping tube 136, and inner telescoping tube 138 may be secured to one another to allow the sleeve and tubes to be positioned variably with respect to one another. In one embodiment, a connector 150, here a lynch pin but other devices may be employed as known to those of skill in the art, may be inserted through an orifice 142 in telescoping sleeve 140 through an orifice 142 in telescoping tube 136 and through an orifice 142 in inner telescoping tube 138 to affix and lock the three pieces relative to one another. In other embodiments, only telescoping sleeve 140 and telescoping tube 136 may comprise independent lift stanchion 130 and be affixed relative to one another and locked into position via connector 150. While independent lift stanchion 130 is shown in FIG. 2 as comprising three sections, more or less sections are considered within the scope of this disclosure such as 2, 4, 5, 6, or more sections. Additional sections may be fixed in relative position to one another via insertion of additional connectors 150 or other means as known to those of skill in the art such as lynch pins, bolts, carter pins, rods, etc.

One feature of the current invention is to bias connector 150 through orifice 142 in outer telescoping sleeve 140 via means such as via bias device 152, herein a leaf spring but other bias means such as ball bearing containing members, notches, etc., as known to those of skill in the art, are considered within the scope of the disclosure. While FIG. 2 shows a partially exploded via of connector 150, FIG. 1 shows connector 150 as it appears during use. Bias device 152 ensures that connector 150 remains within orifice 142 of exterior wall 144 of outer telescoping sleeve 140 and extends through orifice 142 defined in outer wall 146 of telescoping tube 136 (and other tubes, if employed). This ensures that independent lift stanchion 130 remains locked or affixed at the selected position/height without fear of slipping or the members of independent stanchion 130 moving relative to one another when a weight is on lifting frame 102.

In order to provide convenience for the user, multiple connectors 150 may be joined to one another via a connector extension 154. In use, one would be able to disengage multiple connectors 150 simultaneously via pulling or pushing on connector extension 154, herein a wire cable, but other means such as rope, rods, pulleys, an elastomeric member, etc., may be employed as known to those of skill in the art to simultaneously remove connector 150 from the inner-most orifice 142 into which it is inserted. Bias device 152 would ensure that connector 150 remains within orifice 142 of outer telescoping sleeve 140 such at that the two remain engaged. In a further embodiment, the user may be informed of the height and or angle of lifting frame 102 via graduations 156 shown on the exterior of inner telescoping tube 138, and/or other inner tubes, that show the height and or angle of independent stanchions 130. While FIG. 1 shows two pairs of connectors 150 connected to one another on first side 108 and second side 110, all four connectors may be affixed or cooperatively joined via simply adding more connector devices 154 along third side 112 and fourth side 114 to interconnect all four independent lift stanchions.

Further, the design of multi-point elevator 100 allows for extending the height and varying the angle of an object supported thereon by allowing independent stanchions 130 to move independently of one other. For purposes of example only and not intended to be limiting, two independent stanchions on first side 108 may be raised to a height of 3 feet and two independent stanchions 130 on second side 110 may be raised to the same height, a lower height, or higher than the stanchions of first side 108. In a further example, and again not intended to be limiting, four independent stanchions positioned along first side 108, second side 110, third side 112, and fourth side 114 would allow a user to achieve four separate heights in order to place an object at angles not only to the X-Y plane but to the X-Z and/or Y-Z planes as well. This could be used in cases wherein it is desired to lift and tilt or rotate an object on multiple axes for better access. One example being to lift a lawn mower or car and tilting same "forward" or "backward" (with respect to the orientation of the vehicle) as well as "right" or left" (again with respect to the orientation of the vehicle) such that the oil pan is tilted to optimize flow through the oil pan opening to speed up an oil change. For example, a car could be tilted "forward" and "right" to place the opening in the oil pan at a lowest possible point with respect to the remainder of the oil pan to increase the oil flow.

In order to protect the object being lifted, such as the hull of a boat or plane, multipoint lift elevator 100 may comprise at least one contact feature 156 that will engage a bottom surface of the object being lifted. Contact feature 156 may be a polyurethane pad, a nonwoven sheet, cloth, padding, foam, etc., as known to those of skill in the art. In a further embodiment, contact feature 156 may be "tacky" or otherwise have increased surface tension or increased friction to prevent the object being lifted from shifting or sliding with respect to lifting frame 102. Further, a lip or raised edge 158 of contact feature may be used to keep the object confined within the grip of multiple contact features. In one embodiment, contact feature 156 may employ at least two raised edges 158 joined at an angle, such as right, obtuse or acute, on upper surface 160 of contact feature 156 in order to form an angle support for the object being raised.

Multi-point lift elevator may be made mobile via use of wheels 162 that may be affixed in pairs or singly to any or all sides of the lift elevator. Wheels 162 may also include locking mechanisms, as known to those of skill in the art, to prevent wheels 162 from moving while life elevator 100 is in use.

While multi-point lift elevator 100 is shown with a manual operated hydraulic jack 164 to supply the lifting force via contact with and raising lower raising surface 106, thereby raising at least a portion of lifting frame 102, multi-point lift elevator 100 may also power independent lift stanchions 130 via affixing motivator means such as a motor, hydraulic lifts, etc., as known to those of skill in the art, to all independent lift stanchions 130 cooperatively or each independent lift stanchion 130 individually. This would allow for motorized control, rather than manual hydraulic lifting and lowering, of lifting frame 101.

In a preferred embodiment, multi-lift point elevator 100 comprises four independent lift stanchions 130 that each include a single telescoping tube 136 wherein lifting frame 102 is substantially rectangular in configuration.

A further benefit of the current disclosure is that the telescoping tubes contained within outer telescoping sleeve 140, such as for purposes of example only, inner telescoping tube 138 and telescoping tube 136, but more or less tubes are considered defined within the scope of the disclosure, are gravity fed downward when a side of lifting frame 102 is raised. For instance, forming multipoint lift elevator 100 of hollow, substantially square-shaped, steel tubing and nesting at least one telescoping tube within telescoping sleeve 140 results in the at least one nested telescoping tube remaining in contact with the surface supporting multipoint lift elevator 100 while telescoping sleeve 140, which is at least removably affixed, if not permanently affixed, to at least one side of lifting frame 102 is raised along with the sides of lifting frame 102. This gravity feed system reduces the need for complex catch mechanisms. When the nested leg lowers, a first orifice 142 within that leg will engage with connector 150 (or a next adjacent orifice 142 along the telescoping tube if a prior adjacent orifice has been disengaged), which is being biased inward by bias device 152 through orifice 142 located in outer telescoping sleeve 140.

Figure 3:
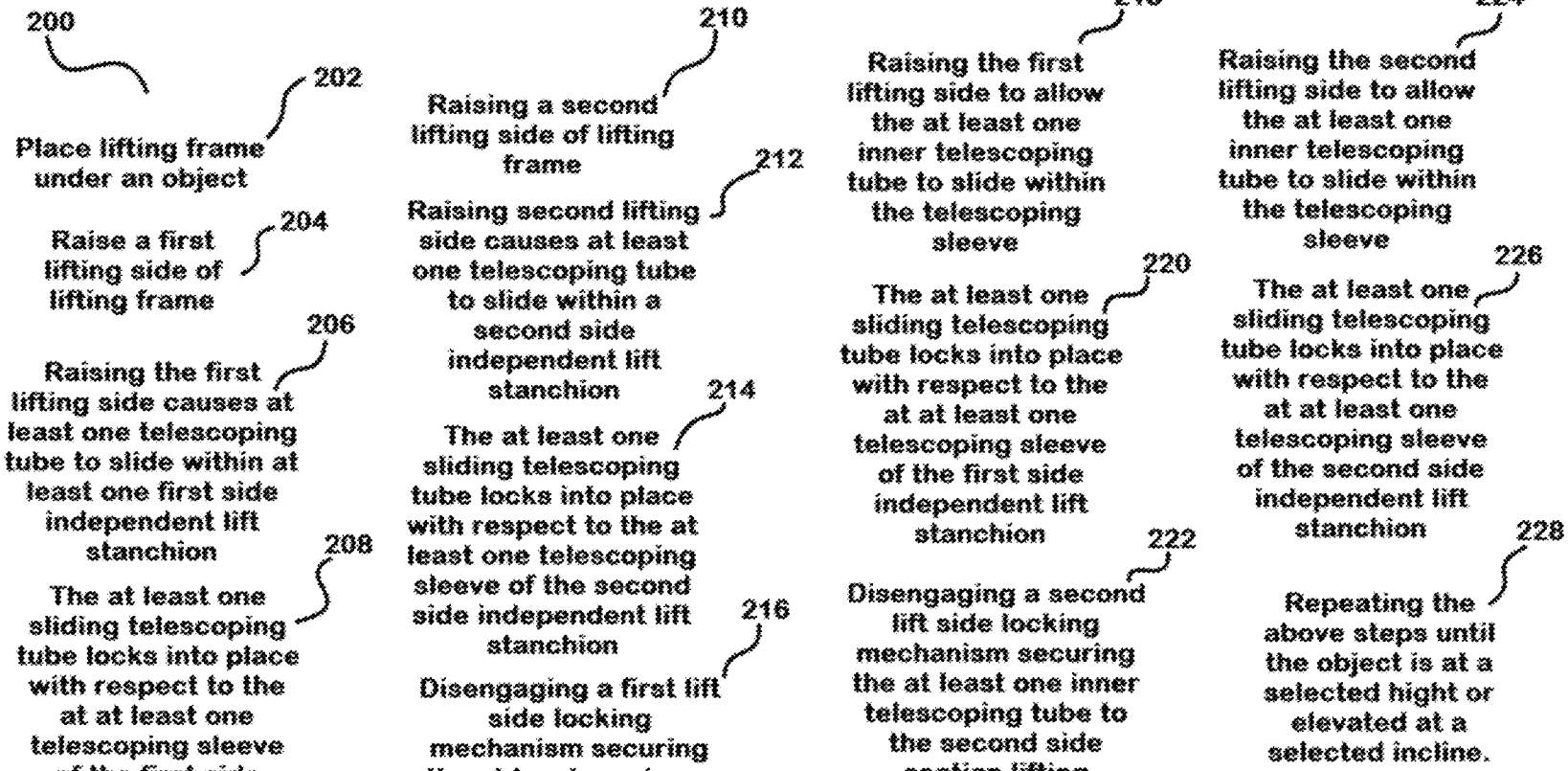
FIG. 3 shows a method for lifting an object via a multi-lift point elevator of the current disclosure.

In a further embodiment, as shown by FIG. 3, a method 200 is provided for lifting an object via a multi-lift point elevator. At step 202, the lifting frame is placed underneath an object. At step 204, a first lifting side of the lifting frame is raised. At step 206, raising the first lifting side of the lifting frame allows at least on telescoping tube to slidably move within at least one telescoping sleeve. At step 208, the sliding telescoping tube locks into place with respect to the at least one telescoping sleeve. At step 210, a second lifting side of the lifting frame is raised. At step 212, raising the second lifting side allows at least one inner telescoping tube of at least one second side independent lift stanchion affixed to the second lifting side to slidably move within an outer telescoping sleeve. At step 214, the at least one sliding telescoping tube locks into place with respect to the at least one telescoping sleeve of the second side independent lift stanchion. At step 216, a first lifting side locking mechanism securing the at least one inner telescoping sleeve to the at least one outer telescoping sleeve of the first side lifting stanchion is disengaged. At step 218, again raising the first lifting side to allow the at least one inner telescoping sleeve to slidably move within the outer telescoping sleeve. At step 220, the at least one sliding telescoping tube locks into place with respect to the at least one telescoping sleeve. At step 222, a second lift side locking mechanism securing the at least on inner telescoping tube to the second side section lifting stanchion is disengaged. At step 224, again raising the second lifting side raising to allow the at least one inner telescoping tube to slidably move within the outer telescoping sleeve. At step 226, the telescoping tube locks into place with respect to the outer telescoping sleeve. At step 228, the above continues until the object is raised to a selected height or elevated at a selected incline.

Figure 4:
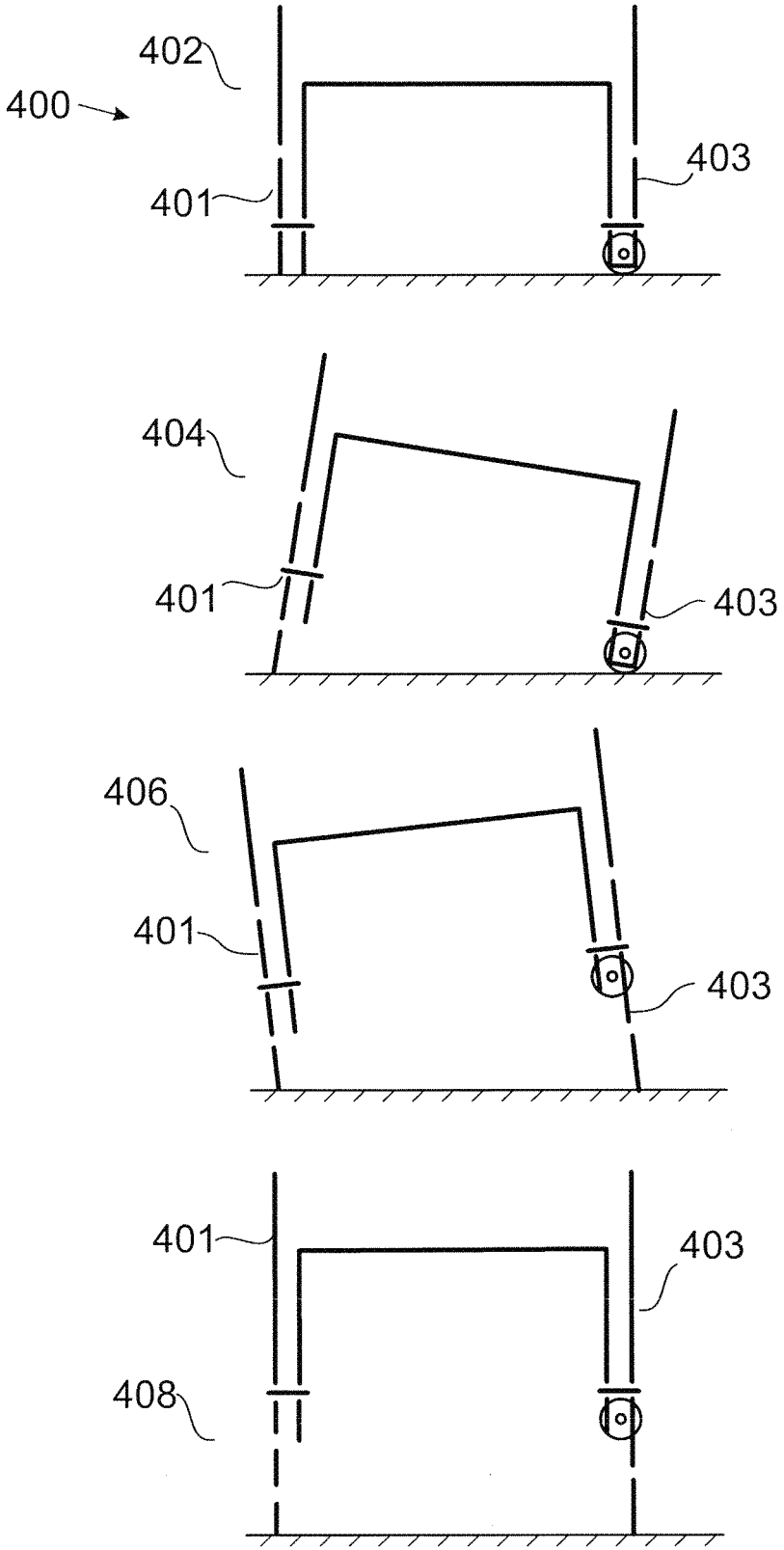
FIG. 4 illustrates one embodiment of a "see-saw" or variable lifting method of the current disclosure.

FIG. 4 illustrates one embodiment of a "see-saw" or variable lifting method 400 of the current disclosure. At step 402, the multi-point lift elevator is flat or "even" and first side 401 is equal in height to second side 403. At step 404, first side 401 has been raised above second side 403. At step 406, second side 403 has been raised higher than first side 401. At step 408, first side 401 has been brought to an even height with second side 403. While this method is illustrated, the current disclosure also discloses wherein one sides may be raised higher than the opposite side, and the opposite side is then brought even with the side originally raised, then the original raised side may be elevated above the opposite side, etc., until both sides are brought even, or left at a desired incline wherein one side is at a lower height than the opposing side. While only two sides are discussed, the disclosed movement may be used for each independent lift stanchion to provide both "rear" and "forward" tilt as well as "right" and "left" tilt.

Figure 5:
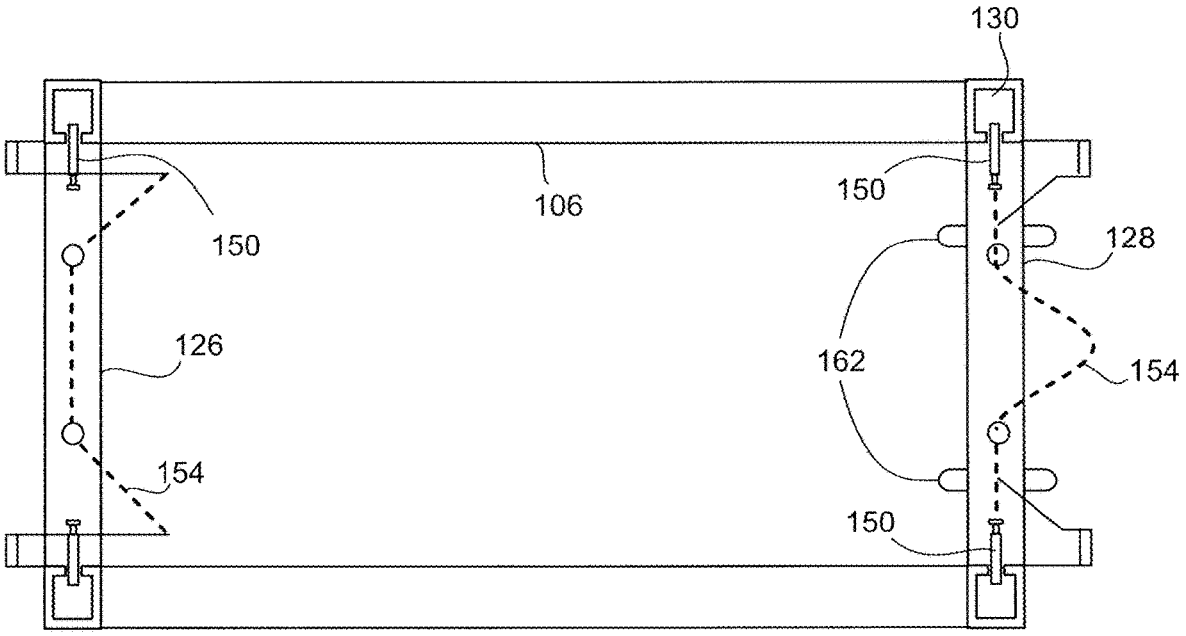
FIG. 5 illustrates a top down view of a lower raising surface of the current disclosure.
Figure 6:
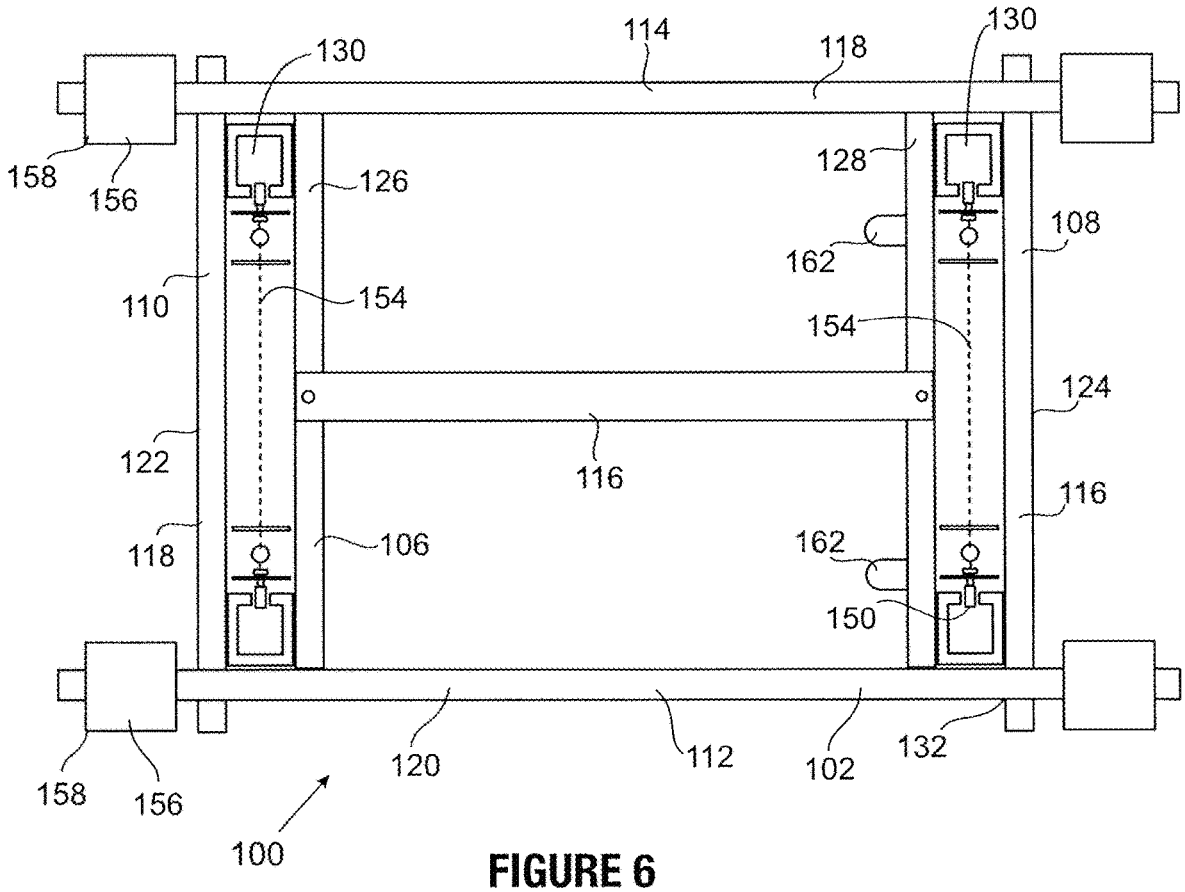
FIG. 6 is a top down view of multipoint lift elevator of the current disclosure.
Figure 7A:
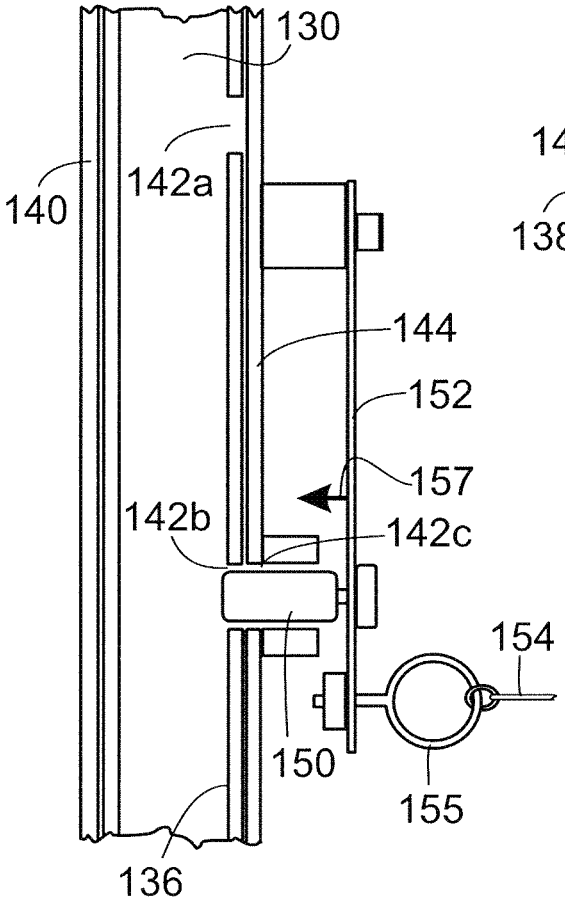
FIGS. 7A and 7B show an enlarged view of a connector of the current disclosure in an engaged and disengaged configuration.
Figure 7B:
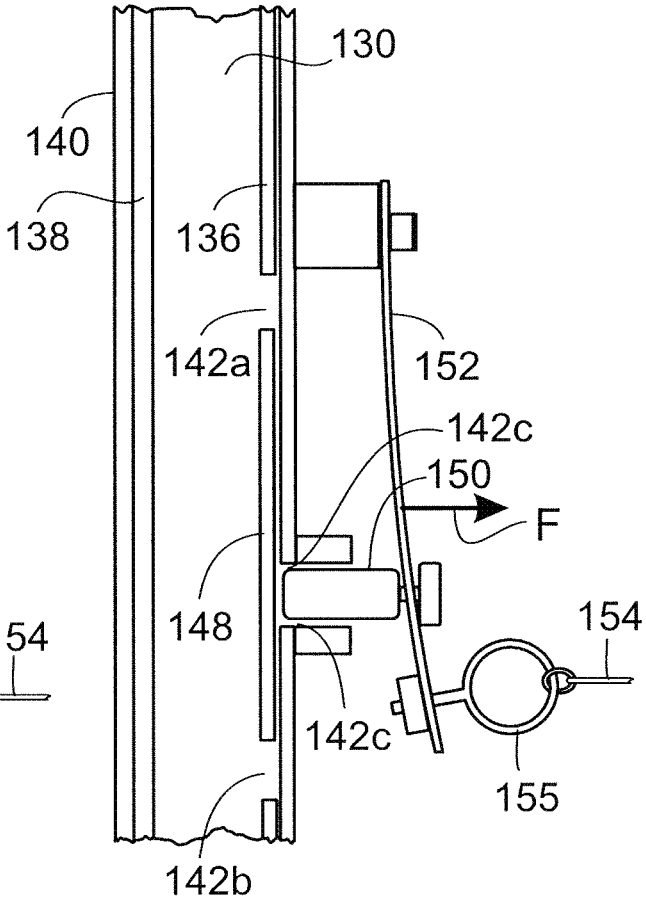

FIG. 5 is a top down view of lower raising surface 106. FIG. 6 is a top down view of multipoint lift elevator 100. FIGS. 7A and 7B show an enlarged view of connector 150 engaged, see FIG. 7A, and disengaged, see FIG. 7B from inner telescoping tube 138. As FIGS. 7A and 7B show, bias device 152 may be connected to connector extension 154 via means such as an eyelet 155, which may be a loop, screw with eyelet, hook, etc., as known to those of skill in the art, which may be removably or permanently affixed to bias device 152 in order to allow force F exerted on connector extension 154 to pull connector 150 (or a pair, three, four or more connectors 150) from orifice 142 in telescoping tube 136 in order to allow telescoping tube 136 to move within telescoping sleeve 140 via the effect of gravity. In this example, connector 150 was original inserted through orifice 142*c*, defined within exterior wall 144 of outer telescoping sleeve 140, and through orifice 142*b* defined in surface wall 148 of inner telescoping tube 138.

Here, as shown by the progression illustrated by FIG. 7A to FIG. 7B, in an unloaded state, i.e., no weight from the object supported by lifting frame 102 is exerted downward, once force F is applied to connector extension 154, connector 150 disengages from orifice 142*b* as bias force 157 exerted on connector 150 via bias device 152 is overcome by force F. Once connector 150 is removed from orifice 142*b*, telescoping tube 136 moves downward due to the effect of gravity. Also, orifice 142*a* moves toward orifice 142*c* and connector 150. Orifice 142*a* will eventually engage connector 150 if force F is removed to allow bias device 152 to once again bias connector 150 toward telescoping tube 136 via bias force 157.

In use, downward movement of lifting frame 102, especially when under the weight of an object positioned on lifting frame 102, may be controlled or prevented by placing a jack or other support under lower raising surface 106 to control the downward movement of lifting frame 102 when connector 150 is removed from independent support stanchion 130. This allows controlled movement of lifting frame 102 in either an upward or downward direction. For lowering lifting frame 102, bias force 157 also allows a user to disengage connectors 150 and lower lifting frame 102 due to gravity as when no force F is applied to connector extension 154, bias force 157 will force connector 150 to enter the next available orifice as telescoping sleeve 140 moves downward with respect to telescoping tube 136 due to gravity pulling downward on lifting frame 102. When raising lifting frame 102, removal of connector 150 from the engaged orifice of telescoping tube 136 allows the weight of telescoping tube 136 to cause telescoping tube 136 to remain stationary while telescoping sleeve 140 is raised with respect to telescoping tube 136 by being lifted in tandem with lifting frame 102 away from the surface supporting multi-point lift elevator 100. Once an orifice on telescoping tube 136 located above the original orifice from which connector 150 was withdrawn aligns with orifice 142*c*, connector 150 then "snaps" into the new orifice and reengages with telescoping tube 136 due to bias force 157.

Figure 8:
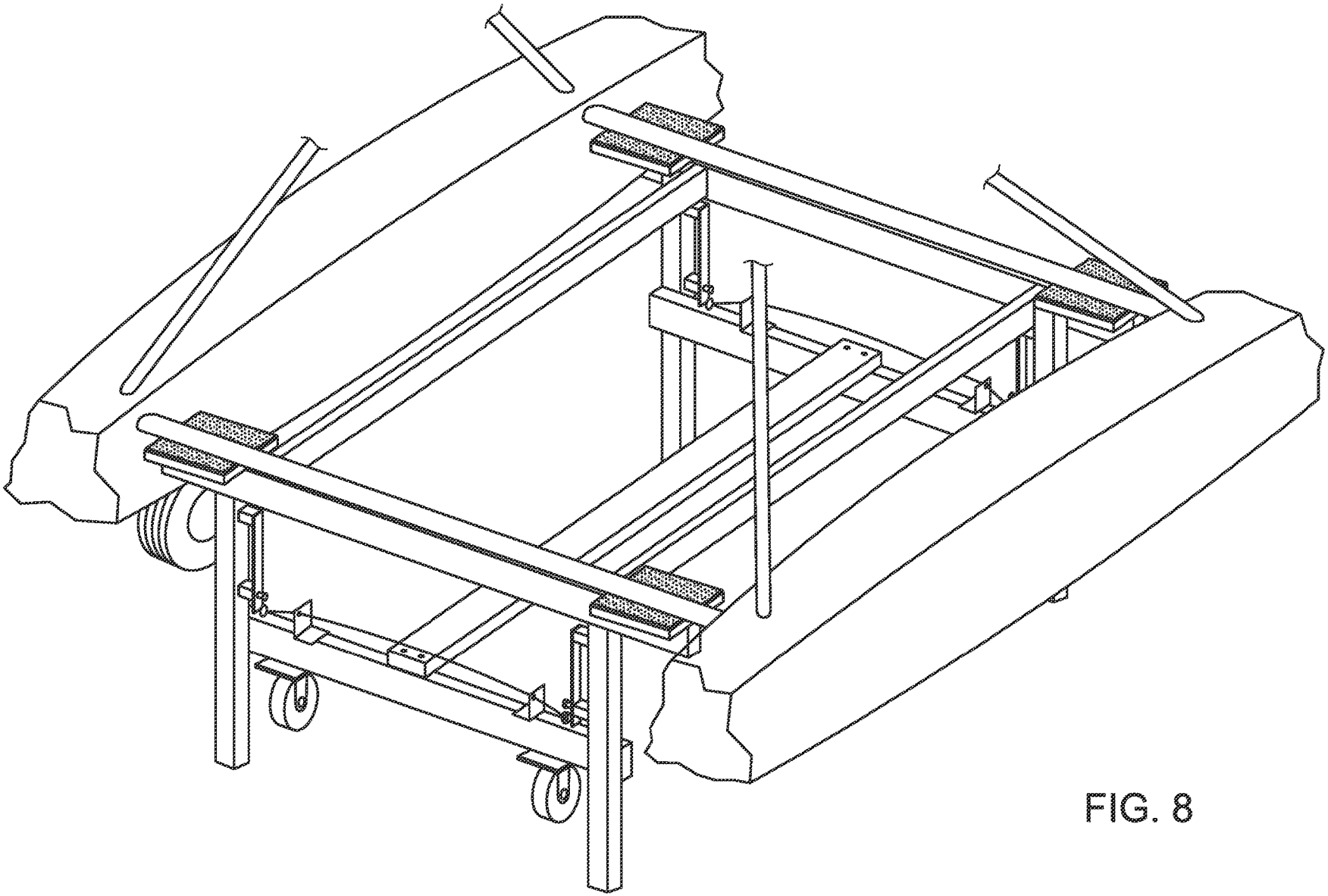
FIG. 8 shows a perspective view of a multipoint lift elevator of the current disclosure engaged with the undercarriage of a seaplane.

FIG. 8 shows a perspective view of multipoint lift elevator 100 engaged with the undercarriage of a seaplane.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A multi-lift point elevator for lifting a plane, comprising:

a lifting frame having a lower raising surface and an upper lifting surface being configured to receive and elevate a seaplane;

an independent lift stanchion affixed to the lower raising surface and the upper lifting surface, the lift stanchion having an outer telescoping sleeve defining a plurality of orifices therethrough and an inner telescoping tube defining a plurality of complementary orifices therethrough;

a leaf spring connected to the outer telescoping sleeve by a bias force, the leaf spring having at least two bias connectors depending therefrom in a direction of the outer telescoping sleeve orifices and the inner telescoping tube complementary orifices, the two bias connectors being urged through the respective outer telescoping sleeve orifices and inner telescoping tube complementary orifices when aligned therewith;

a connector extension connected to the leaf spring and to the lower raising surface; and a jack being configured for contact with the lower raising surface to control the lifting frame, the connector extension being configured to overcome the bias force to move the leaf spring away from the outer telescoping sleeve and release the two bias connectors from the outer telescoping sleeve orifices and the inner telescoping tube complementary orifices to permit the inner telescoping tube to extend from the outer telescoping sleeve as the jack elevates the seaplane on the upper lifting surface.

2. The multi-lift point elevator as in claim 1, further comprising an additional lift stanchion spaced apart from the independent lift stanchion, an additional leaf spring, and an additional connector extension, the additional lift stanchion having another inner telescoping tube and another outer telescoping sleeve, the additional leaf spring being connected by another bias force to the outer telescoping sleeve of the additional lift stanchion, and the additional connector extension being connected to the additional leaf spring, wherein, as the jack respectively supplies lowering or raising forces to each of the lift stanchions, the respective connector extensions are configured to overcome the respective bias forces to release the respective leaf springs to insert or release the respective inner telescoping tubes relative to the outer telescoping sleeves of the respective lift stanchions.

* * * * *